United States Patent [19]

Rossato

[11] Patent Number: 4,848,732

[45] Date of Patent: Jul. 18, 1989

[54] PANTOGRAPH LIFTING RAMPS PARTICULARLY FOR MOTOR VEHICLES

[76] Inventor: Eride Rossato, Via Mazzini, 7, Ballo' Di Mirano(Venezia), Italy

[21] Appl. No.: 495,180

[22] Filed: May 17, 1983

[51] Int. Cl.[4] ..... B66F 7/12

[52] U.S. Cl. ..... 254/90; 254/10 R; 254/89 H; 254/133 R; 254/134; 187/8.5; 187/8.72

[58] Field of Search ..... 33/203.12, 203.14; 91/433; 137/498, 517; 187/8.41, 8.47, 8.49, 8.5, 8.71, 8.72, 40, 41; 254/8 R, 8 B, 10 R, 10 B, 89 H, 90, 133, 134

[56] References Cited

U.S. PATENT DOCUMENTS

| | | | |
|---|---|---|---|
| 2,203,136 | 6/1940 | Fowler | 33/203.14 |
| 2,583,384 | 1/1952 | Mercier | 137/498 |
| 3,330,381 | 7/1967 | Halstead | 187/8.5 |
| 3,432,006 | 3/1969 | Senger | 187/8.72 |
| 4,447,042 | 5/1984 | Masui | 254/90 |

FOREIGN PATENT DOCUMENTS

| | | | |
|---|---|---|---|
| 255801 | 7/1948 | Switzerland | 254/91 |

*Primary Examiner*—James G. Smith
*Assistant Examiner*—Judy J. Hartman
*Attorney, Agent, or Firm*—Kimmel, Crowell & Weaver

[57] ABSTRACT

A pantograph lifting ramp for motor vehicles includes a pair of wheel guides supported by at least two pairs of columns, which are pivoted at their lower ends to two base frames. The columns of at least one pair have their lower ends connected through a torsion bar consisting of connectable sections. The lifting ramp includes a safety valve to prevent uncontrolled descent in case of failure of the hydraulic fluid system, and another safety device to arrest lowering of the lifting ramp if a worker's foot is accidentally placed between the base frame and a column or wheel guide during lowering of the ramp.

13 Claims, 3 Drawing Sheets

FIG. 5.
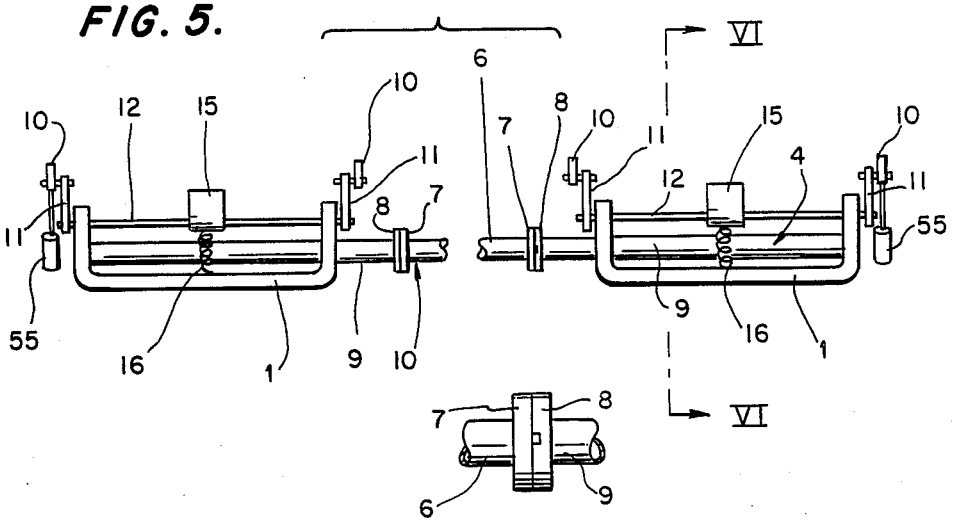
FIG. 5a
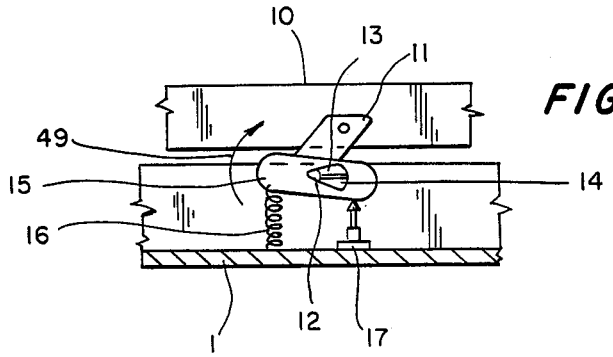
FIG. 6.
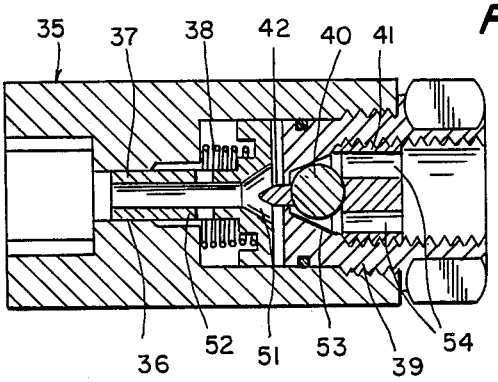
FIG. 7.

PANTOGRAPH LIFTING RAMPS PARTICULARLY FOR MOTOR VEHICLES

BACKGROUND OF THE INVENTION

The present invention relates to a vehicle lift or ramp of the pantograph or parallelogram type.

Lifts of this type are known in which a pair of base frames resting on the floor are connected with parallel elevatable wheel guides through pairs of columns having their ends pivotally connected with the base frames and wheel guides, together with hydraulic jacks to raise and lower the structure.

Generally, the base frames and wheel guides are C-shaped in cross section, with the aim of nesting these parts to reduce height when the structure is lowered, and at the same time providing a housing space for the lifting jacks and associated parts when the structure is lowered.

Also generally the two wheel guides are connected by sturdy cross bars to prevent unequal lifting, resulting in the formation of a horizontal lifting platform at the tops of the pairs of columns.

A major objective of this invention is to eliminate the necessity for cross bars or other braces beween the vehicle wheel guides, so that the space between the wheel guides is entirely open and unobstracted, thereby greatly facilitating service operations on the elevated vehicle without impeding the worker's movements.

Another object of the invention is to provide a vehicle lift of the mentioned type which can be easily knocked down for storage and transportation.

Yet another object is to provide a vehicle lift having safety means to stop the descent of the device in the event of failure of the hydraulic system supplying the lifting jacks, and in case a foot of a worker is placed between relatively moving parts of the descending structure.

Another object of the invention is to provide means for controlling the trim of vehicle wheels in a correct way, namely, with the four wheels of the vehicle placed in a truly horizontal plane.

Other features and advantages of the invention will become apparent during the course of the following detailed description.

BRIEF DESCRIPTION OF THE DRAWINGS

FIG. 5 is a transverse vertical section taken on line 5—5 of FIG. 1.

FIG. 5*a* is an enlargement of the parts circled in FIG. 5.

FIG. 6 is an enlarged fragmentary vertical section taken on line 6—6 of FIG. 5.

FIG. 7 is an enlarged fragmentary horizontal section through a safety valve taken on line 7—7 of FIG. 4.

DETAILED DESCRIPTION

Figures 1, 1A:
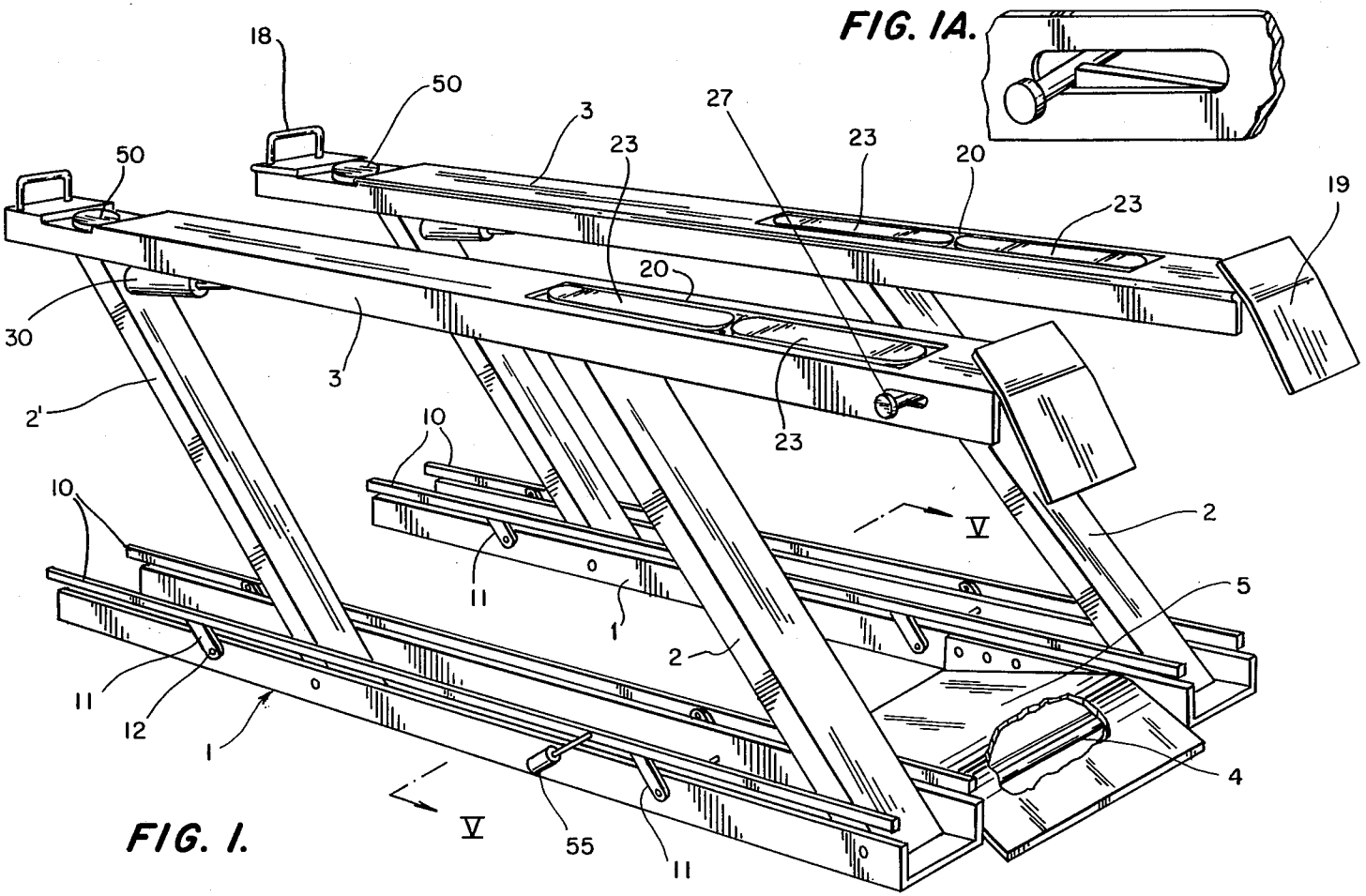
FIG. 1 is a perspective view of a vehicle lifting ramp according to the invention.
FIG. 1A is an enlarged view of the locking device of FIG. 1.

Referring to the drawings in detail wherein like numerals designate like parts, a vehicle lifting ramp comprises a pair of spaced parallel base frames 1 adapted to rest on a floor, a pair of spaced parallel vehicle wheel guides 3, and two pairs of columns 2 and 2' having their ends pivotally attached to the base frames and wheel guides in a parallelogram configuration.

The rear columns 2 of the device are connected at their lower ends by a sturdy torsion bar 4 covered for security reasons between the base frames 1 by a detachable cover 5. The torsion bar 4 is sectionally formed, including a center portion 6 having coupling flanges 7 and two end portions 9 having coupling flanges 8. The two portions 9 of the torsion bar 4 are rigidly secured to the columns 2 as by welding.

To assure easy dismantling of the structure at required times, the cover 5 is detachably secured by bolts to the inner faces of base frames 1, and while in place assures proper spacing and parallelism of the base frames.

Along both longitudinal edges of each base frame 1 and substantially coextensive therewith are rigid strips 10, pivotally attached to short links 11, connected to the base frames 1 through transverse shafts 12 which are rotatable. The strips 10 are biased upwardly by spring pusher devices 55 connected between the strips and base frames 1. A small plate 13, FIG. 6, is radially fixed to the center portion of each shaft 12 and this plate is housed in a fan-shaped recess 14, formed in an eccentric element 15 which can pivot about the shaft 12 but is restrained from moving axially along the shaft.

The small plate 13 is resiliently biased against the upper edge of the fan-shaped opening 14 by the action of a spring 16, connected between the eccentric element 15 and the base frame 1.

A microswitch 17 is disposed between the other end of eccentric element 15 and the base frame 1, and this switch serves, in conjunction with an electrically operated valve, not shown, in the hydraulic circuit of the device, to stop the outflow of oil from the lifting jacks in the event that a worker's foot enters between the base frames 1 and the columns 2 and 2' or the wheel guides 3. Each of the wheel guides 3 is provided at its forward end with an obstacle 18 to block the wheels of the vehicle, and at its rear end with an inclined ramp 19 to facilitate entry of the vehicle onto the lift when it is fully lowered so that the columns 2 and 2' are nested inside of the channel-shaped base frames 1.

Each wheel guide 3 in its rear portion has a cut-out 20 containing fixed depressed plates 21 on which are mounted spaced spherical supports 22. A pair of plates 23 rest freely on the spherical supports substantially flush with the top face of wheel guide 3. The plates 23 can shift freely in all directions within the areas defined by the cut-outs 20. Preferably their ends are arcuate as shown at 23' in FIG. 2 to allow limited rotation of the plates 23 as well as lateral and longitudinal movements on the spherical supports 22.

The lengths of the cut-outs 20 and their distance from the front ends of the wheel guides 3 is such that when any vehicle has its front wheels resting on the conventional discs 50, the rear wheels of the vehicle will be on one of the plates 23 of each guide 3, thus making it possible for the ramp to accommodate motor vehicles of any wheel pitch.

Figure 2:
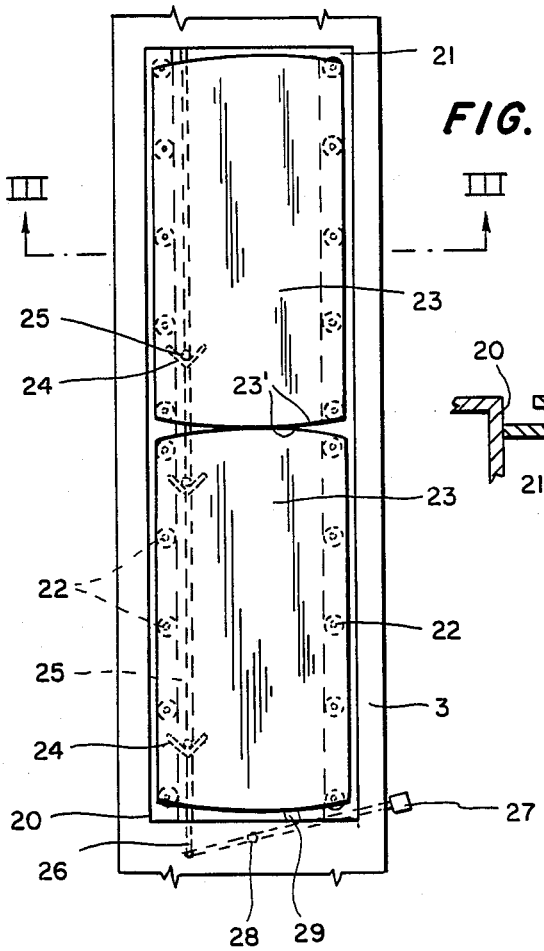
FIG. 2 is an enlarged fragmentary plan view of one wheel guide of the lifting ramp.
Figure 3:
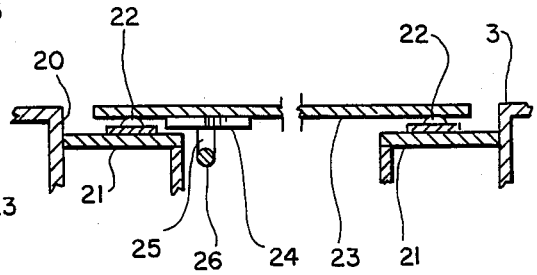
FIG. 3 is a transverse vertical section taken on line 3—3 of FIG. 2.

A pair of V-shaped elements 24 is fixed to the bottom of each plate 23 is which a pin 25 connected to an underlying bar 26 can be engaged, the bar being shiftable by a lever 27, pivoted to a pin 28, FIG. 2, fixed to the wheel guide 3. A pusher element 29 is carried by the lever 27 between the knob of the lever and the pivot pin 28, the usher element 29 acting on the transverse edge of the adjacent movable plate 23.

Figure 4:
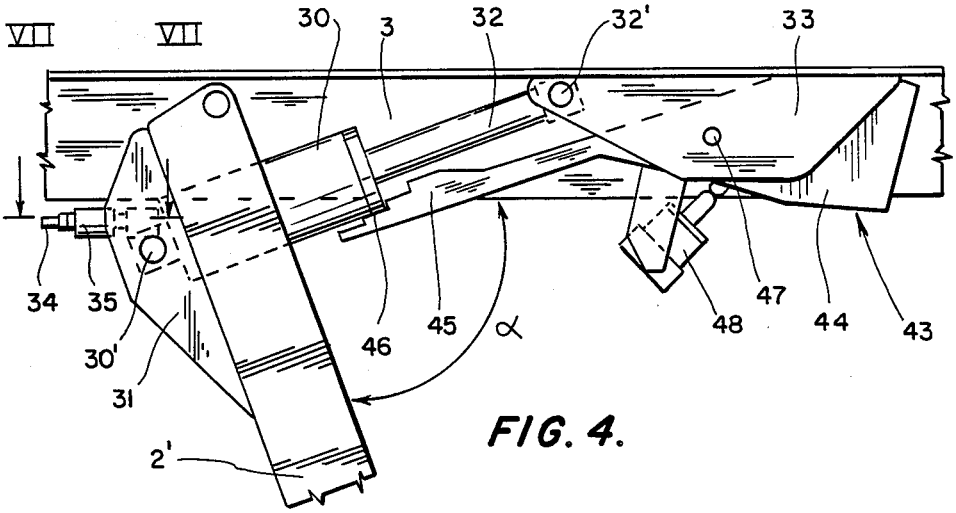
FIG. 4 is an enlarged fragmentary side elevation, partly in section, of a wheel guide and associated lifting jack and column.

Between each front column 2' and one of the wheel guides 3 is a single acting hydraulic jack 30 operable to raise the lifting ramp to a working position. The cylinder body of the jack 30, FIG. 4, is pivotally connected at 30' to a plate 31 welded to each column 2'. the jack rod 32 is similarly pivoted at 32' to a plate 33 welded to the wheel guide 3. The chamber of each jack cylinder is in communication with a hydraulic circuit 34 through a safety valve 35, which prevents the outflow of fluid from the jack cylinder should hydraulic pressure between the inlet and outlet of the cylinder drop below a prefixed value.

As shown in FIG. 7, the safety valve 35 comprises a hollow body 36 in which piston 37 and opposing spring 38 are housed. The piston 37 includes an axially projecting portion 42 and a pair of divergent ducts 51 which connect the piston surface on which the projecting portion 42 is applied to an axial duct 52, communicating with the hydraulic circuit 34.

Applied to the hollow body 36 is a nut 39 which is hollow, having a conical seat 53 receiving a ball 40. The sphere 40 is floatingly held in the hollow nut 39 and held captive by another nut 41 threaded into the nut 39 and being provided with two passages 54 in communication with the seat 53 and with the jack 30.

The resiliency of the spring 38 is such as to allow regular outflow of the operative fluid from the jack 30 through the safety valve 35 during the descent of the lifting ramp.

To the plates 33 of each wheel guide 3 elements 43 are pivoted at 47. These elements include body portions 44 and toothed extensions 45. The teeth of extensions 45 can engage the rear end of each jack 30 thus forming a pawl or positive stop.

In the absence of external pressure, the weight of body portion 44 maintains the toothed extension 45 engaged with the jack end 46. This position can be altered by rotation of the element 43 on its pivot 47 by means of a small cylinder or jack 48 fixed to the wheel guide 3, and having a spring, not shown, for elastic return when the cylinder 48 is in the rest position.

OPERATION

When the lifting ramp is lowered, the jacks 30 are fully retracted and are housed between base frames 1 and vehicle wheel guides 3 whose side flanges may register and engage each other. The inclined ramps 19 allow vehicle wheels to roll from the floor onto the tops of guides 3 at this time. The toothed extensions 45 lie beneath the jacks 30.

In order to elevate the lifting ramp and control the wheel trim of the vehicle, the following procedure is carried out:

Preliminarily, the lever 27 is moved in the direction to axially move the bar 26 so as to cause engagement of the pins 25 in the V-shaped elements 24, and simultaneously placing the pusher element 29 against the edge of plate 23, FIG. 2. After having locked the levers 27 in this position, the plates 23 of each wheel guide 3 are also firmly locked with respect to the same guide.

At this point, the vehicle is driven onto the guides 3 and forwardly until its front wheels are on the discs 50.

To lift the ramp, fluid is introduced via the safety valve 35 into the jack cylinders 30. Extension of the piston rods 32 occurs, gradually increasing the angle $\alpha$, FIG. 4, between the front columns 22 and wheel guides 3. This results in elevating the vehicle while keeping it level. During this lifting, the toothed extension 45 of the element 43 slides along the rear edge 46 of the jack 30 with a ratcheting action, providing positive mechanical security against the lifting ramp's descent should the hydraulic system fail.

When the unit is elevated to the desired height, the lever 27 is released and swung in the opposite direction on the pivot 28, thereby freeing the plates 23 and allowing them to adjust themselves freely on the sphere supports 22 to equalize stresses through the rear wheels of the vehicle.

Servicing of the elevated vehicle can be performed with complete safety and convenience. There are no cross bars or braces between the guides 33 to interfere with movement of the workers while servicing the vehicle. The torsion bar 4 uniformly distributes the weight of the vehicle on the two wheel guides 3 even in the case of unequal vehicle loading.

To lower the lifting ramp, the two cylinders 48 are pressurized to act on the elements 43 and turn them on their pivots 47 to disengage the toothed extension 45 from the jacks 30, thus allowing fluid to be expelled from the jack cylinders due to the weight of the ramp and vehicle.

The elastic reaction of the valve spring 38 on the piston 37 forces the projection 42 against the sphere 40 to unseat it, allowing fluid outflow from the jack cylinder through the nut 39, the ducts 54 of nut 41, the space between the sphere 40 and seat 53, ducts 51, and duct 52 and the external hydraulic circuit 34.

If, during this lowering of the ramp, or for any other reason, a failure downstream from the valve 35 occurs, and fluid flow increaes suddently with a consequent drop in pressure, the lifting ramp cannot fall. The ducts 51 are inadequate for the passage of the whole operative fluid flow which presses against the head of piston 37, overcoming the force of spring 38 and moves the projecting portion 42 away from the sphere 40. Consequently, the sphere being acted upon by the fluid, engages the conical seat 53 and completely shuts off the flow of fluid from the jack cylinder.

If, during the lowering of the lifting ramp, the worker unintentionally places a foot on one of the base frames 1, this will depress the strip 10 and cause rotation of the shaft 12. This, in turn, rotates the small plate 13 in the recess 14 of the eccentric 15 and allows the spring 16 to rotate the eccentric in the direction of the arrow in FIG. 6 for operating the microswitch 17, instantly blocking the lowering of the ramp, thus preventing crushing of the worker's foot.

As soon as the foot is removed from the strip 10, the spring pushers 55 return the strip 10 to the normal elevated position. This causes rotation of the shaft 12 in the opposite direction whereby the small plate 13 engages the upper edge of recess 14, rotating the eccentric 15 against the force of compression spring 16, until the microswitch 17 is de-activated.

It may be seen that the lifting ramp according to this invention possesses the following advantages over the prior art:

(1) complete elimination of cross bars between the two wheel guides 3, enabling complete accessability to all parts of the vehicle;

(2) a high degree of safety while lowering the ramp due to the safety valve 35, after the safety elements 43 are in the inactive positions;

(3) provides for control of the trim of the four vehicle wheels keeping the resting place of the vehicle level and avoiding movement thereof during servicing;

(4) the ability to be used with motor vehicles of differing wheel pitch; and (5) the ability to be nearly completely disassembled which reduces space during shipment from the manufacturer or while storing the ramp in its knocked-down state.

I claim:

1. A lifting ramp for motor vehicles comprising a pair of spaced base frames adapted to rest on a floor, a pair of vehicle wheel guides adpated to be raised and lowered relative to the base frames, pairs of columns pivotally connected with their lower ends to the base frames and with their upper ends to the wheel guides, a torsion bar connecting the lower ends of at least one pair of said columns, means to connect the base frames to one another, and power means to raise and lower the wheel guides and columns relative to the base frames.

2. A lifting ramp for motor vehicles as defined in claim 1, and the torsion bar comprising a plurality of separably connected sections.

3. A lifting ramp for motor vehicles as defined in claim 1, and a cover for the torsion bar between the base frames.

4. A lifting ramp for motor vehicles as defined in claim 3, and means releasably securing said cover to the base frames.

5. A lifting ramp for motor vehicles as defined in claim 1, and a pair of strips mounted to opposite sides of each base frame and being substantially coextensive therewith and being spaced above the base frame, and means to stop the lowering of the lifting ramp connectad with and operated by depression of one of said strips.

6. A lifting ramp for motor vehicles as defined in claim 5, and resilient means acting on said strips to maintain them spaced above the tops of the base frames.

7. A lifting ramp for motor vehicles as defined in claim 1, and each of the wheel guides having a longitudinal opening in its rear end portion, and at least a plate movably mounted within said opening substantially flush with the top face of the wheel guide and being free to move in a plane parallel with the top face of the wheel guide, and means bringing the plate in its centered position with respect to the opening end to lock said plate against movement relative to the wheel guide.

8. A lifting ramp for motor vehicles as defined in claim 7, and spherical support elements for said plate on the wheel guide below the top face of the wheel guide.

9. A lifting ramp for motor vehicles as defined in claim 7, and a pair of said plates within said opening, each plate being substantially rectangular and having curved ends, whereby each plate can shift within the opening in any direction.

10. A lifting ramp for motor vehicles as defined in claim 7, and a manual operating lever for said means to lock said plate with respect to the corresponding wheel guide of the lifting ramp, said lever being provided with detent means in the locking position.

11. A lifting ramp for motor vehicles as defined in claim 10, and the plate having spaced V-shaped elements fixed to its lower side adapted to receive pins rising from an axially shiftable bar operatively connected with the manual operating lever.

12. A lifting ramp for motor vehicles comprising a pair of spaced base frames adapted to rest on a floor, a pair of vehicle wheel guides adapted to be raised and lowered relative to the base frames, pairs of columns pivotally connected with their lower ends to the base frames and with their upper ends to the wheel guides, a torsion bar connecting the lower ends of at least one pair of said columns, means to connect the base frames to one another, and power means to raise and lower the wheel guides and columns relative to the base frames, each of the wheel guides having a longitudinal opening in its rear portion and at least a plate movably mounted within said opening substantially flush with the top face of the wheel guide and being free to move in a plane parallel with the top face of the wheel guide, means to lock said plate against movement relative to the wheel guide, and a manual operating lever for said means to lock said plate on each wheel guide of the lifting ramp.

13. A lifting ramp for motor vehicles as defined in claim 12, and the plate having spaced V-shaped elements fixed to its lower side adapted to receive pins rising from a shiftable bar operatively connected with the manual operating lever.

* * * * *